US008206884B2

(12) United States Patent
Yang et al.

(10) Patent No.: US 8,206,884 B2
(45) Date of Patent: Jun. 26, 2012

(54) METHOD OF PREPARING TONER USING MICRO-SUSPENSION PARTICLES AND TONER PREPARED USING THE METHOD DIGITAL IMAGE DATA

(75) Inventors: Woo Young Yang, Daejeon (KR); Keon Il Kim, Daejeon (KR); Dae Il Hwang, Daejeon (KR); Jae Bum Park, Daejeon (KR); Il Sun Hwang, Daejeon (KR); Jun Hee Lee, Daejeon (KR); Jae Kwang Hwang, Daejeon (KR); Dong Won Kim, Daejeon (KR); Duck Kyun Ahn, Daejeon (KR)

(73) Assignee: Samsung Fine Chemicals Co., Ltd., Ulsan (KR)

( * ) Notice: Subject to any disclaimer, the term of this patent is extended or adjusted under 35 U.S.C. 154(b) by 337 days.

(21) Appl. No.: 12/528,314

(22) PCT Filed: Feb. 20, 2008

(86) PCT No.: PCT/KR2008/000978

§ 371 (c)(1), (2), (4) Date: Aug. 21, 2009

(87) PCT Pub. No.: WO2008/102975

PCT Pub. Date: Aug. 28, 2008

(65) Prior Publication Data

US 2010/0098462 A1 Apr. 22, 2010

(30) Foreign Application Priority Data

Feb. 23, 2007 (KR) ..... 10-2007-0018501

(51) Int. Cl.
*G03G 5/00* (2006.01)

(52) U.S. Cl. ..... 430/137.14; 430/137.1; 430/109.4; 399/252

(58) Field of Classification Search ..... 430/137.14, 430/137.1, 109.4; 399/252
See application file for complete search history.

(56) References Cited

U.S. PATENT DOCUMENTS 5,691,095 A 11/1997 Shinzo et al.

FOREIGN PATENT DOCUMENTS

| | | |
|---|---|---|
| EP | 1 441 259 | 7/2004 |
| JP | 08-211655 | 8/1996 |
| KR | 100185630 | 4/1999 |
| KR | 10-2004-0025812 | 3/2004 |
| KR | 10-2004-0096296 | 11/2004 |
| KR | 1020040096296 A | 11/2004 |
| KR | 1020050058614 A | 6/2005 |

OTHER PUBLICATIONS

International Search Report, PCT/KR2008/000978, dated Jun. 9, 2008.

*Primary Examiner* — Mark A Chapman
(74) *Attorney, Agent, or Firm* — Nixon Peabody LLP

(57) ABSTRACT

A method of preparing a toner using a micro-suspension particle, includes preparing a mixture by mixing a resin having acidic groups, a master batch of coloring pigment, and at least one additive with an organic solvent, and then neutralizing the acid groups of the resin with a base; forming a micro-suspension by adding the prepared mixture to a dispersion medium; and forming a toner composition by removing the organic solvent from the prepared micro-suspension. Therefore, the method of preparing a toner using the disclosed micro-suspension particle and a toner prepared using the same can save manufacturing costs, and can improve charging ability and cleaning properties of the toner.

8 Claims, 1 Drawing Sheet

METHOD OF PREPARING TONER USING MICRO-SUSPENSION PARTICLES AND TONER PREPARED USING THE METHOD DIGITAL IMAGE DATA

CROSS-REFERENCE TO RELATED PATENT APPLICATION

This application is a national phase of International Application No. PCT/KR2008/000978, entitled "METHOD OF PREPARING TONER USING MICRO-SUSPENSION PARTICLES AND TONER PREPARED USING THE METHOD", which was filed on Feb. 20, 2008, and which claims priority of Korean Patent Application No. 10-2007-0018501, filed on Feb. 23, 2007 in the Korean Intellectual Property Office, the disclosure of which is incorporated herein in its entirety by reference.

BACKGROUND OF THE INVENTION

1. Technical Field

The present invention relates to a method of preparing a toner using micro-suspension particles, and a toner prepared using the method, and more particularly, to a toner using micro-suspension particles which can save manufacturing costs and enhance charging ability and cleaning properties, and a toner prepared using the method.

2. Background Art

There is increasing demand for a toner optimized for high speed printing, particularly a toner using a polyester resin.

The method of preparing such a toner can be categorized into physical and chemical methods.

The physical methods include pulverization. Pulverization is a method of preparing a toner by melt-mixing a colorant, charge control agent and the like with a resin such as polyester, dispersing the resulting melt-mixture homogenously and then pulverizing and classifying the toner composition obtained. The pulverization method requires a pulverizing device in order to pulverize the toner composition. Therefore, it is expensive to prepare a toner with small particle diameters, and also inefficient. Moreover, when pulverizing the toner composition, particles with a wide particle size distribution are likely to be formed, and in order to obtain an image of high resolution and/or high gradation, it is necessary to classify and remove fine particles with a diameter of 3 μm or less and coarse particles with a diameter of 20 μm or greater. In addition, if the additives are not dispersed homogenously in the toner, fluidity, developability, durability, and/or image quality of the toner may be degraded.

Meanwhile, chemical methods include suspension-polymerization method and emulsion-aggregation method.

Suspension-polymerization is a method of preparing a toner by suspension-polymerizing the toner materials in a suspension medium. Canon etc. possesses such type of technology (U.S. Pat. No. 6,177,223). This method may improve the problems regarding the pulverization method, but is disadvantageous in that only styrene-acrylic copolymers are used as basic resin, and the toner particles obtained thereby are sphere-shaped, having a reduced cleaning property. Therefore, toner prepared by the suspension-polymerization method causes the toner to remain on a photoconductor of an electrophotographic image forming device. The toner remained and accumulated on the photoconductor may produce poor image quality, and may result in contamination of a charging roller and the like, as well as a problem of not being able to achieve the original charge ability.

Another chemical method of preparing a toner composition is emulsion-aggregation (U.S. Pat. Nos. 5,916,725, 6,268,103). This method includes preparing a micro-emulsion resin particle composition through an emulsion polymerization reaction, and aggregating the composition with a separate dispersion such as pigment dispersion. Such a method may improve the problems regarding the pulverization method and results in the toner particles being formed to be non-spherical by controlling aggregating conditions. However, the method is disadvantageous in that only styrene-acrylic copolymers are used as basic resin, and preparation of dispersion such as pigment dispersion should be further included.

The two chemical methods of preparing toner described above use only styrene-acrylic copolymers as basic resin. Therefore, polyester resin having excellent properties such as excellent fluidity, excellent dispersion of pigments derived from the chemical structure of the resin and excellent transparency, cannot be used in general color toners and toners for high speed-printing.

A method of preparing a toner using a polyester resin includes a method of using self-water dispersible polyester (U.S. Pat. No. 5,916,725), but this method requires resin having sodium sulfonate group or the like in its chain in order to make self-water dispersion possible. Also, the toner, which includes many functional groups introduced in this way is likely to be influenced by external environmental factors such as moisture after manufacturing, which may decrease the stability of the toner.

U.S. Pat. No. 6,416,917 discloses a dry toner including a toner binder and a colorant. The toner binder includes a high molecular weight polyester resin and a low molecular weight oligomeric resin having urea or urethane bonds. Such a toner accompanies a chemical reaction during preparation of the toner particles, making it difficult to control the properties of the toner, and condensation cannot be easily achieved within the aqueous phase.

Japanese Patent No. 3063269 discloses a method of preparing a toner by dissolving a resin having acidic groups in an organic solvent, disperse-mixing a colorant in the solution, and then neutralizing the acid groups with a base through phase transition emulsification. However, when preparing a toner using this method, it is difficult to increase the solid contents, and viscosity increases at the point of phase-transition, raising the shear rate. Moreover, controlling the morphology is difficult, and thus a spherical toner is likely to be formed. Also, a separate classifying process may be required due to a difficulty in obtaining a narrow size distribution. Moreover, water-oil-water (W/O/W) particles may be formed during the phase-transition emulsification process, having possibility to form pores within the toner particles. In addition, a high-speed shearing machine or the like must be used in order to disperse the colorant in the organic solvent in which the resin is dissolved.

DISCLOSURE OF THE INVENTION

The present invention provides a method of preparing a toner allowing cost-saving and a toner prepared using the method.

The present invention also provides a method of preparing a toner that can improve a charging ability of the toner and a toner prepared using the method.

The present invention also provides a method of preparing a toner that can enhance cleaning properties of the toner and a toner prepared using the method.

The present invention also provides an electrophotographic image forming device using the toner.

According to the present invention, there is provided a method of preparing a toner including:

preparing a mixture by mixing a resin having acidic groups, a master batch of coloring pigment, and at least one additive with an organic solvent, and then neutralizing the acid groups of the resin with a base;

forming a micro-suspension by adding the prepared mixture to a dispersion medium; and forming a toner composition by removing the organic solvent from the prepared micro-suspension.

According to an aspect of the present invention, the resin having acidic groups may be a polyester resin with a number average molecular weight of 2,000-10,000, PDI (polydispersity index) of 2-15, THF insoluble part of 1 wt % or less, and acid value of 5-100 mg KOH/g.

According to a preferable aspect of the present invention, acid value of the polyester resin may be 7-30 mg KOH/g.

According to another aspect of the present invention, the coloring pigment master batch may be formed of 60 to 80 wt % of resin having acidic groups and 20 to 40 wt % of coloring pigment.

According to yet another aspect of the present invention, the method of preparing a toner may further include, after forming the toner composition, aggregating the toner composition; melt-adhering the aggregated toner composition; and forming toner particles by washing and drying the melt-adhered toner composition.

According to yet another aspect of the present invention, the resin having acidic groups may have at least one acid group selected from the group consisting of carboxylic group, phosphoric acid group, and sulfonic acid group.

According to yet another aspect of the present invention, the additive includes at least one of a charge control agent and a releasing agent.

According to yet another aspect of the present invention, the dispersion medium includes a polar solvent, a surfactant, a thickener, or a mixture thereof.

The present invention also provides a toner prepared according to any one of the embodiments above, and having a volume average particle size of 2.0 to 10.0 μm, 80% span value of 0.9 or less, and a shape factor of 0.6-1.0.

According to another aspect of the present invention, there is provided an electrophotographic image forming device using the toner.

BRIEF DESCRIPTION OF THE DRAWINGS

The above and other features and advantages of the present general inventive concept will become more apparent by describing in detail exemplary embodiments thereof with reference to the attached drawings in which.

BEST MODE FOR CARRYING OUT THE INVENTION

Figure 1:
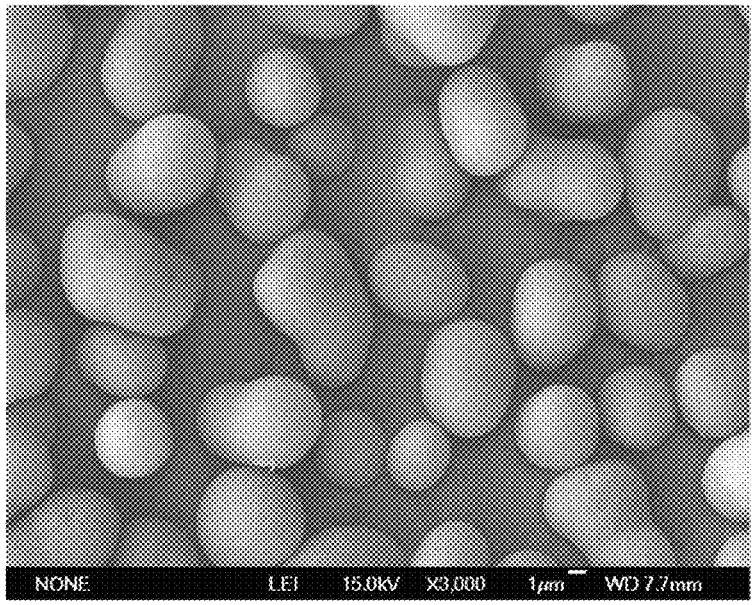
FIG. 1 is a scanning electron microscopy (SEM) image of toner particles prepared using a method of preparing a toner according to an embodiment of the present invention.

Hereinafter, the present invention will now be described more specifically with reference to the exemplary embodiments.

A method of preparing a toner according to the present embodiment uses a resin having acidic groups, a colorant, and at least one additive.

First, a resin having acidic groups is described.

The acidic groups are introduced to the resin by chemical bonding. Such acidic groups which can be neutralized by a base, forms anions within an aqueous solution, having a hydrophilic property. Therefore, the resin having acidic groups can be dispersed and stabilized in the form of a particle within an aqueous solution. The acidic groups may be at least one selected from the group consisting of carboxylic group, phosphoric acid group, and sulfonic acid group.

The resin having acidic groups may comprise a polyester-based resin, which is particularly desirable with respect to colorant dispersion and fixing property at low temperature. The polyester-based resin may be, for example, a resin obtained with a monomer compound having an acid group which can be neutralized as an essential ingredient, such as carboxyl group-containing polyester-based resin, sulfonic acid group (such as sodium dimethyl 5-sulfoisophthalate salt)-containing polyester-based resin, or phosphoric acid group-containing polyester-based resin. Among these, carboxyl group-containing polyester-based resin is preferable, in which the number average molecular weight may be 2,000-10,000, the poly dispersity index (PDI) may be 2-15, THF insoluble content may be 1 wt % or less, the glass transition temperature may be 45-75° C., and the acid value may be 5-100 mg KOH/g. If the number average molecular weight is less than 2,000, the melt viscosity becomes too low and the range of fixing temperature becomes narrow, and if the number average molecular weight is greater than 10,000, large particles are formed while forming particles, and particle size distribution is widened. Furthermore, if the PDI is less than 2, the range of fixing temperature becomes narrow, and if the PDI is greater than 15, it becomes difficult to obtain a resin having THF insoluble content of less than 1 wt %. If the THF insoluble content is greater than 1 wt %, it is difficult to prepare micro-suspended particles. Moreover, if the acid value is lower than 5 mg KOH/g, the following preparation of toner micro-suspension becomes difficult, and if the acid value is greater than 100 mg KOH/g, environmental stability of the prepared toner may be significantly decreased. More preferably, the acid value may be 7-30 mg KOH/g.

In this case, the polyester resin may be prepared by condensation-polymerization in which polyhydric alcohol component and polybasic carboxylic acid component are mixed and heated, optionally, under a reduced pressure atmosphere and/or in the presence of a catalyst, whenever necessary. Polyhydric alcohol components specifically include polyoxyethylene-(2,0)-2,2-bis(4-hydroxyphenyl)propane, polyoxypropylene-(2,0)-2,2-bis(4-hydroxyphenyl)propane, polyoxypropylene-(2,2)-polyoxylethylene-(2.0)-2,2-bis(4-hydroxyphenyl)propane, polyoxyethylene-(2,3)-2,2-bis(4-hydroxyphenyl)propane, polyoxypropylene-(6)-2,2-bis(4-hydroxyphenyl)propane, polyoxypropylene(2,3)-2,2-bis(4-hydroxyphenyl)propane, polyoxypropylene-(2,4)-2,2-bis(4-hydroxyphenyl)propane, polyoxypropylene-(3,3)-2,2-bis(4-hydroxyphenyl)propane, polyoxyethylene-(6)-2,2-bis(4-hydroxyphenyl)propane, ethylene glycol, 1,3-propylene glycol, 1,2-propylene glycol, 1,4-butylene glycol, 1,3-butylene glycol, and glycerol. Polybasic carboxylic acid components include aromatic or aliphatic polybasic acids conventionally used in polyester resin preparation and/or alkyl esters thereof. Examples of such aromatic or aliphatic polybasic acids may include terephthalic acid, isophthalic acid, trimellitic acid, pyromellitic acid, 1,2,4-cyclohexane tricarboxylic acid, 2,5,7-naphthalene tricarboxylic acid, 1,2,4-naphthalene tricarboxylic acid, 1,2,5-hexane tricarboxylic acid, 1,2,7,8-octane tetracarboxylic acid, and/or alkyl esters of these carboxylic acids, and as the alkyl group, methyl, ethyl, propyl, butyl group may be used. The polybasic acid and/or alkyl esters thereof may be used individually or in a combination of two or more compounds.

The content of the resin having acidic groups may be 50 to 98 parts by weight based on 100 parts by weight of the total toner composition. If the content of the resin having acidic groups is less than 50 parts by weight based on 100 parts by weight of the total toner composition, the resin is insufficient for binding the components of the toner composition, and if the content of the resin having acidic groups is greater than 98 parts by weight based on 100 parts by weight of the total toner composition, the toner composition content except for the resin is small, making it difficult to preserve the function of a toner. Here, the toner composition broadly includes, besides the resin having acidic groups, a colorant and an additive which will be described later. Meanwhile, the colorant is not used in the form of a coloring pigment itself, but in a coloring pigment master batch form in which coloring pigment is dispersed within the resin. The coloring pigment master batch refers to a resin composition in which a coloring pigment is evenly dispersed, and is prepared by blending the coloring pigment and the resin under high temperature and high pressure, or by adding the coloring pigment to the resin solution and applying a high shearing force to disperse the coloring pigment. By using the coloring pigment master batch, a homogenous micro-suspension solution may be prepared by suppressing the exposure of pigment while preparing toner micro-suspension. The coloring pigment master batch used in the present embodiment is formed of 60 to 80 wt % of the resin having acidic groups and 20 to 40 wt % of the coloring pigment. If the content of the coloring pigment is lower than 20 wt %, a desired color may not be reproduced due to too low amount of the pigment of the toner, and if the content of the coloring pigment is greater than 40 wt %, the pigment dispersion within the coloring pigment master batch is not likely to be homogenous, and is therefore not desirable.

The coloring pigment may be selected appropriately from pigments widely used commercially, such as black pigment, cyan pigment, magenta pigment, yellow pigment, and a mixture thereof.

Examples of such pigment types may be as follows. That is, the black pigment may be titanium oxide or carbon black. The cyan pigment may be copper phthalocyanine compound and derivatives thereof, anthraquine compound, or a base dye lake compound. Specifically, the cyan pigment may be C.I. pigment blue 1, 7, 15, 15:1, 15:2, 15:3, 15:4, 60, 62, 66, or the like. The magenta pigment may be condensed nitrogen compound, anthraquine, quinacridone compound, base dye lake compound, naphthol compound, benzo imidazole compound, thioindigo compound, or perylene compound. Specifically, the magenta compound may be C.I. pigment red 2, 3, 5, 6, 7, 23, 48:2, 48:3, 48:4, 57:1, 81:1, 144, 146, 166, 169, 177, 184, 185, 202, 206, 220, 221, 254, or the like. The yellow pigment may be condensed nitrogen compound, isoindolinone compound, anthraquine compound, azo metal complex, or allyl imide compound. Specifically, the yellow pigment may be C.I. pigment yellow 12, 13, 14, 17, 62, 74, 83, 93, 94, 95, 109, 110, 111, 128, 129, 147, 168 or the like.

The content of the colorant may be an amount sufficient to form a visible image by development through coloring the toner. In this regard, the content of the colorant may preferably be 3-15 parts by weight based on 100 parts by weight of the resin having acidic groups. If the content of the colorant is less than 3 parts by weight based on 100 parts by weight of the resin having acidic groups, coloring effect is insufficient, and if the content of the colorant is greater than 15 parts by weight based on 100 parts by weight of the resin having acidic groups, the electrical resistance of the toner becomes low, such that sufficient frictional charge amount cannot be obtained, thereby causing contamination.

Meanwhile, the additive may be a charge control agent, a releasing agent, or a mixture of the two. The charge control agent may be a negative-charging charge control agent or a positive-charging charge control agent. The negative-charging charge control agent may be an organic metal complex or chelate compound such as chrome-containing azo complex or a monoazo metal complex; a salicylic acid compound containing metal such as chrome, iron, or zinc; and an organic metal complex of an aromatic hydroxycarboxylic acid and an aromatic dicarboxylic acid. However, the negative-charging charge control agent is not particularly limited insofar as it is conventionally used. Moreover, the positive-charging charge control agent may be Nigrosine and modified products of Nigrosine modified with a fatty acid metal salt, and an onium salt including a quaternary ammonium salt such as tributylbenzylammonium 1-hydroxy-4-naphthosulfonate and tetrabutylammonium tetrafluoroborate, individually or as a mixture of two or more types. Such a charge control agent charges the toner stably and rapidly by static electricity, and thus stably supporting the toner on a developing roller.

The content of the charge control agent included in the toner may generally be within the range of 0.1 to 10 parts by weight based on 100 parts by weight of the toner composition.

The releasing agent may enhance the fixing ability of the toner image and may be polyalkylene wax such as low molecular weight polypropylene and low molecular weight polyethylene, ester wax, carnauba wax and paraffin wax.

Moreover, the additive may further include a long chain fatty acid, or the like. The long chain fatty acid may be appropriately used in order to prevent deterioration of developing properties and obtain high quality images.

Furthermore, the additive may further include external additives. External additives are used for enhancing the fluidity or controlling the charging properties of the toner, and may include large particulate silica, small particulate silica and polymer beads.

Hereinafter, the present invention will be described more in detail with reference to a method of preparing a toner, according to an embodiment of the present invention.

First, a resin having acidic groups, a coloring pigment master batch, and at least one additives are mixed in an organic solvent at a temperature of 40 to 95° C. Then, the acid groups of the resin are neutralized with a base to form a mixture.

Next, the prepared mixture is added to a dispersion medium formed of a polar solvent, a surfactant, and optionally a thickener, at a temperature of 60-98° C. and is stirred to form a micro-suspension.

Next, the micro-suspension is stirred at a temperature of 60-98° C. and then the organic solvent is removed by evaporation to form a toner composition.

Consecutively, an aggregating agent is added to the prepared toner composition and is aggregated by controlling the temperature and the pH. In this case, the aggregated toner composition has a low rigidity, and the shape of the toner composition is very irregular.

Next, the aggregated toner composition is melt-adhered to obtain a toner composition of a desired particle size. By melt-adhering the aggregated toner composition, the rigidity of the toner composition is strengthened, and the shape thereof becomes regular. In addition, according to the degree of the melt-adhering, the shape of the toner composition may have various shapes from contorted sphere to complete sphere.

Finally, the melt-adhered toner composition is cooled, washed and dried to obtain toner particles.

The organic solvent used in the preparation method is volatile, has a lower boiling point than the polar solvent, and is not mixed with the polar solvent, and may include for example, at least one type selected from the group consisting of esters such as methyl acetate or ethyl acetate; ketones such as acetone or methylethylketone; hydrocarbons such as dichloromethane or trichloroethane; and aromatic hydrocarbons such as benzene.

The polar solvent may be at least one selected from the group consisting of water, glycerol, ethanol, ethylene glycol, propylene glycol, diethylene glycol, dipropylene glycol, and sorbitol, among which water is preferable.

The thickener may be polyvinylpyrrolidone, polyvinyl alcohol, polyacrylic acid, gelatin, chitosan, or sodium alginate.

The surfactant may be at least one selected from the group consisting of nonionic surfactant, anionic surfactant, cationic surfactant, and amphoteric surfactant.

Nonionic surfactants include polyvinyl alcohol, polyacrylate, methylcellulose, ethylcellulose, propylcellulose, hydroxylethylcellulose, carboxymethylcellulose, polyoxyethylene cetyl ether, polyoxyethylene lauryl ether, polyoxyethylene octylphenyl ether, polyoxyethylene octylphenyl ether, polyoxyethylene stearyl ether, polyoxyethylene norylphenyl ether, ethoxylate, phosphate norylphenols, triton, and dialkylphenoxypoly(ethyleneoxy) ethanol. Anionic surfactants include sodium dodecyl sulfate, sodium dodecylbenezene sulfonate, sodium dodecyl naphthalene sulfate, dialkyl benzenealkyl sulfate, and sulfonate, and cationic surfactants include alkyl benzene dimethyl ammonium chloride, alkyl trimethyl ammonium chloride, and distearyl ammonium chloride. Amphoteric surfactants include amino acid amphoteric surfactant, betaine amphoteric surfactant, lecitin, taurin, cocoamidopropylbetaine, and disodium cocoamphodiacetate.

The surfactants described above may be used by themselves or by mixture of two or more surfactants in a predetermined ratio.

The base used in neutralizing the acidic groups, that is, a neutralizer, may be, for example, an alkaline compound such as sodium hydroxide or lithium hydroxide, carbonate of alkaline metals such as sodium, potassium, and lithium, alkaline metal acetate; alkanolamines such as ammonium hydroxide, methylamine, or dimethylamine. Among these, alkaline compounds are preferable.

The neutralizer may be used at 0.1-3.0 equivalents, preferably 0.5-2.0 equivalents, per 1 equivalent of the acidic group of the resin with acid groups.

The aggregating agent of the toner core may be a surfactant used in a dispersion, a surfactant having an opposite polarity to the surfactant used in a dispersion or a monovalent or higher inorganic metal salt. Generally, as the ionic charge number increases, the aggregating ability increases, and therefore a suitable aggregating agent should be selected taking into account the aggregating rate of the dispersion or the stability of the method of preparation. The monovalent or higher inorganic metal salt may be, specifically, calcium chloride, calcium acetate, barium chloride, magnesium chloride, sodium chloride, sodium sulfate, ammonium sulfate, magnesium sulfate, sodium phosphate, sodium dihydrophosphate, ammonium chloride, cobalt chloride, strontium chloride, cesium chloride, nickel chloride, rubidium chloride, potassium chloride, sodium acetate, ammonium acetate, potassium acetate, sodium benzoate, aluminum chloride, and zinc chloride.

The toner prepared using the method according to the present embodiment may be used in an electrophotographic image forming device. Here, an electrophotographic image forming device refers to a device such as a laser printer, a copier, or a facsimile.

Hereinafter, the present invention is described more in detail with reference to the following examples. These examples are for illustrative purposes only and are not intended to limit the scope of the present invention.

EXAMPLES

Synthesis of Polyester Resin

Preparation Example 1

Synthesis of Polyester Resin 1

A 3-liter reactor equipped with a stirrer, a nitrogen gas inlet, a thermometer, and a condenser was placed in an oil bath in which the oil is a thermal transfer medium. Various monomers, that is, 50 parts by weight of dimethyl terephthalate, 47 parts by weight of dimethyl isophthalate, 80 parts by weight of 1,2-propylene glycol, and 3 parts by weight of trimellitic acid were added to the reactor. Then, dibutyl tin oxide was added as a catalyst at a ratio of 500 ppm with respect to the total weight of the monomers. Next, the mixture was stirred at a rate of 150 rpm while increasing the reaction temperature to 150° C. The reaction was then continued for approximately 6 hours, after which the reaction temperature was increased again to 220° C. Sequentially, the pressure of the reactor was decreased to 0.1 torr in order to remove the byproducts, and the reaction was completed after maintaining this pressure for 15 hours. As a result, polyester resin 1 was obtained.

After the reaction was completed, the glass transition temperature (Tg) of the polyester resin 1 was measured using a differential scanning calorimeter (DSC) and was found to be 62° C. Number average molecular weight and PDI of the polyester resin 1 were measured by gel permeation chromatography (GPC) using a standard sample of polystyrene. The number average molecular weight was 4,300, and the PDI was 3.5. The acid value measured by titration was 15 mg KOH/g.

Preparation Example 2

Synthesis of Polyester Resin 2

Polyester resin 2 was prepared using the same method as in Preparation Example 1, except that 70 parts by weight of dimethyl terephthalate, 25 parts by weight of dimethyl isophthalate, 80 parts by weight of ethylene glycol, and 3 parts by weight of trimellitic acid were added as monomers. After the reaction was completed, the glass transition temperature (Tg) of the polyester resin 2 was measured using a differential scanning calorimeter (DSC), and was found to be 66° C. Number average molecular weight and PDI of the polyester resin 1 were measured by gel permeation chromatography (GPC) using a standard sample of polystyrene. The number average molecular weight was 4,000, and the PDI was 3.7. The acid value measured by titration was 8 mg KOH/g.

Preparation of Coloring Pigment Master Batch

Preparation Example 3

Preparation of Black Pigment Master Batch

The polyester resin 1 synthesized from Preparation Example 1 and a carbon black pigment (by Degussa GmbH of Germany, NIPEX 150) were mixed at a weight-based ratio of 8:2. Next, 50 parts by weight of ethyl acetate based on 100 parts by weight of the polyester resin was added to the mixture, and the mixture was heated at a temperature of approximately 60° C. and was stirred with a mixer. Sequentially, the mixture was mixed at a rate of 50 rpm using a biaxial extruder connected to a vacuum apparatus, and ethyl acetate solvent was removed using the vacuum apparatus to obtain a black pigment master batch.

Preparation Example 4

Preparation of Cyan Pigment Master Batch

A cyan pigment master batch was prepared using the same method as in Preparation Example 3, except that a mixture of polyester resin 1 and a cyan pigment (C.I. pigment blue 15:3, color index No. 74160, by DIC, Japanese ink manufacturer) mixed in a ratio of 6:4 was used.

Preparation Example 5

Preparation of Magenta Pigment Master Batch

A magenta pigment master batch was prepared using the same method as in Preparation Example 3, except that a mixture of polyester resin 1 and a magenta pigment (Red 122, by DIC, Japanese ink manufacturer) mixed in a ratio of 6:4 was used.

Preparation Example 6

Preparation of Yellow Pigment Master Batch

A yellow pigment master batch was prepared using the same method as in Preparation Example 3, except that a mixture of polyester resin 1 and a yellow pigment (by Clariant GmbH., Germany) mixed in a ratio of 6:4 was used.

Preparation of Toner Particles

Example 1

120 g of polyester resin 1 synthesized in Preparation Example 1, 80 g of black pigment master batch synthesized in Preparation Example 3, 2 g of (N-23; HB Dinglong Co.), 8 g of paraffin wax, and 300 g of methylethyl ketone as organic solvent were added to a 1-liter reactor equipped with a condenser, a thermometer, and an impeller stirrer. The mixture was stirred at a rate of 600 rpm while adding 50 ml of 1N of NaOH solution, and then was mixed for 5 hours at a temperature of 80° C. in a refluxed state. After confirming that the mixture had sufficient fluidity, it was stirred additionally for 2 hours at a rate of 500 rpm. As a result, a toner mixture was obtained.

800 g of deionized water, 10 g of neutral surfactant (Tween 20, Aldrich Co.), 2 g of sodium dodecyl sulfate which is an anionic surfactant (Aldrich Co.) were added to another 3-liter reactor equipped with a condenser, a thermometer, and an impeller stirrer. The mixture was stirred at a rate of 600 rpm at 85° C. for 1 hour. As a result, a dispersion medium was obtained.

The toner mixture was added to the dispersion medium, and was stirred at a rate of 1000 rpm at 85° C. isothermally for 1 hour, and a micro-suspension solution was formed.

Next, the temperature of the reactor was set at 90° C. under partially reduced pressure of 100 mmHg to remove methylethyl ketone, an organic solvent. As a result, a solid-state toner composition was obtained. When the particle size of the toner composition from which methylethyl ketone was completely removed was measured using a Coulter Multisizer (Beckman Coulter Co.), the volume average particle size was 0.4 p.m.

Subsequently, the temperature within the reactor was cooled to 40° C., 10 g of magnesium chloride dissolved in 50 g of deionized water was slowly added to the reactor, and the temperature was increased over 30 minutes to 80° C. to aggregate the toner composition. After 5 hours, the aggregated toner composition was measured using a Coulter Multisizer (Beckman Coulter Co.), and the volume average particle size was 6.2 p.m.

Next, 500 g of deionized water was added to the reactor and melt-adhesion was performed at 80° C. for 8 hours, and then the reactor was cooled.

Then, the melt-adhered toner composition, that is, toner particles were separated using a filter that is commonly used in the art, washed with 1 N hydrochloric acid solution, and washed again 5 times with distilled water to completely remove a surfactant, and the like. The washed toner particles were dried in a fluidized bed dryer at 40° C. for 5 hours to obtain dried toner particles.

The obtained toner particles were analyzed to have a volume average particle size of 6.5 μm, and 80% span value of 0.65. In addition, as a result of analyzing 100 random toner particle samples by Image J software using a scanning electron microscope (SEM; JEOL Ltd.), a mean shape factor was 0.65.

Example 2

Toner particles were prepared using the same method as in Example 1, except that the reactor was cooled after performing the process of melt-adhering for 30 hours.

Upon analysis of the toner particles obtained, the volume mean particle diameter was 6.8 μm, and 80% span value was 0.62. In addition, as a result of analyzing 100 random toner particle samples by Image J software using a scanning electron microscope (SEM; JEOL Ltd.), a mean shape factor was 0.95.

Example 3

Toner particles were prepared using the same method as in Example 1, except that ethylacetate was used as the organic solvent, instead of methylethyl ketone.

Upon analysis of the toner particles obtained, the volume mean particle diameter was 7.1 μm, and 80% span value was 0.60. In addition, as a result of analyzing 100 random toner particle samples by Image J software using a scanning electron microscope (SEM; JEOL Ltd.), a mean shape factor was 0.69.

Examples 4-6

Toner particles were prepared using the same method as in Example 1 except that 40 g of coloring pigment master batches prepared in Preparation Examples 4, 5 and 6 were used as a colorant respectively instead of black pigment master batch prepared in Preparation Example 3, and 160 g of polyester resin 1 from Preparation Example 1 was used. As a result, for Examples 4 to 6, cyan toner particles, magenta toner particles, and yellow toner particles were obtained respectively.

The toner particles obtained were then respectively analyzed. The cyan toner particles had a volume average particle size of 6.4 μm, 80% span value of 0.64, and a mean shape factor of 0.67, the magenta toner particles had a volume average particle size of 6.6 μm, 80% span value of 0.67, and a mean shape factor of 0.63, and the yellow toner particles had a volume average particle size of 6.1 μm, 80% span value of 0.69, and a mean shape factor of 0.68.

Example 7

Toner particles were prepared using the same method as in Example 1 except that carnauba wax was used as a releasing agent instead of paraffin wax.

The obtained toner particles were analyzed, and were measured to have a volume average particle size of 6.8 μm, and 80% span value of 0.64. In addition, as a result of analyzing 100 random toner particle samples by Image J software using a scanning electron microscope (SEM; JEOL Ltd.), a mean shape factor was 0.62.

Example 8

Toner particles were prepared using the same method as in Example 1 except that polyester resin 2 synthesized from Preparation Example 2 was used.

The obtained toner particles were analyzed, and were measured to have a volume average particle size of 6.6 μm, and 80% span value of 0.64. In addition, as a result of analyzing 100 random toner particle samples by Image J software using a scanning electron microscope (SEM; JEOL Ltd.), a mean shape factor was 0.67.

Comparative Example 1

Toner particles were prepared using the same method as in Example 1 except that a pigment dispersion separately prepared was used instead of the coloring pigment master batch of Preparation Example 3.

16 g of the same pigment used when preparing a black pigment master batch was added to 200 g of deionized water, together with 3 g of sodium dodecyl sulfate, and was dispersed for 2 hours at a rate of 7000 rpm in a Dispermat (by Getzmann) to produce a pigment dispersion.

When the toner particles were analyzed, the volume average particle size was 6.8 μm, and 80% span value was 0.75. In addition, as a result of analyzing 100 random toner particle samples by Image J software using a scanning electron microscope (SEM; JEOL Ltd.), a mean shape factor was 0.66.

The volume average particle sizes of the Examples and the Comparative Example were measured with a Coulter Multisizer 3. The size of the apertures used in the Coulter Multisizer 3 was 100 μm. An appropriate amount of surfactant was added to 50-100 ml of ISOTON-II (Beckman Coulter Co.) which is an electrolyte, and 10 to 20 mg of the measuring toner particles was added thereto and was dispersed for 1 minute in an ultrasonic dispersing apparatus to obtain a sample for the Coulter Multisizer.

In addition, the 80% span value which is an index of the particle size distribution was calculated by Equation 1 below. The volume of toner particles is accumulated from particles of the smallest size in ascending order until the accumulated volume reaches 10% of the total volume of the toner. An average size of the particles up to 10% of accumulated volume is defined as d10. Average particle sizes of the accumulated volume corresponding to 50% and 90% of the total volume of the toner are respectively defined as d50 and d90.

$$80\%\ \text{span value}=(d90-d10)/d50 \qquad \text{<Equation 1>}$$

Here, a relatively small span value means narrow particle distribution, and a relatively large span value means wide particle distribution.

Moreover, the shape factor was calculated by Equation 2 below by measuring SEM images (×1,500) of 100 random toner particles and analyzing them using Image J software.

$$\text{shape factor}=4\pi(\text{area}/\text{perimeter}^2) \qquad \text{<Equation 2>}$$

Here, the area indicates an projected area of the toner and the perimeter indicates a projected circumference of the toner.

This shape factor may be in the range of 0 to 1, and a shape factor closer to 1 means a shape that is more spherical.

Meanwhile, the resins were evaluated by following methods.

Using a differential scanning calorimeter (by Netzsch Co.), the temperature of a sample was increased from 20 to 200° C. at 10° C./min, cooled rapidly to 10° C. at 20° C./min and then heated at 10° C./min to measure the Tg (glass transition temperature, ° C.). The median of each tangent with a baseline near the endothermic curve obtained was defined as Tg.

Acid value (mg KOH/g) was measured by dissolving the resin in dichloromethane, cooling the solution and titrating with 0.1N KOH methyl alcohol solution.

The toner particles prepared using such a method has various shapes with a shape factor in the range of 0.6-1.0, a volume average particle size of 2-10 μm, and an 80% span value of 0.9 or less.

According to the method, the toner particles are prepared by including all of the toner components in the preparation of the micro-suspension, and thus additional process for preparing a pigment dispersion and the like may be omitted. In addition, charge properties of the toner may be improved by suppressing exposure of the coloring agent on the surface of the toner particles using the coloring pigment master batch.

Hereinafter, toner particles prepared in the Examples were evaluated by the following methods.

<Charge Quantity>

0.2 g of toner and 2 g of carrier were mixed for 15 minutes at a stirring rate of 150 rpm, and blow-off charge quantity (Vertex Co.) was measured by a common method of measuring charge quantity of binary toner.

<Cleaning Properties>

The prepared toner particles, and 2 parts by weight of silica (TG 810G; Cabot) and 0.5 parts by weight of silica (RX50, Degussa GmbH) based on 100 parts by weight of the toner particles were mixed, and cleaning properties thereof were evaluated in a CLP-510 printer (Samsung Electronics). Specifically, a life span test was performed with 5% pattern under 25° C./55% conditions, and the cleaning properties were evaluated by measuring the number of printed pages at the point where cleaning defects occurred.

The measured charge quantities and cleaning properties are shown in Table 1 below.

TABLE 1

| Toner Particles | Charge Quantity (uC/g) | Point of Cleaning Defect |
|---|---|---|
| Example 1 | −25.4 | 7300 |
| Example 2 | −24.1 | 4000 |
| Example 3 | −24.6 | 7100 |
| Example 4 | −23.7 | 7200 |
| Example 5 | −25.4 | 7300 |
| Example 6 | −22.6 | 7200 |
| Example 7 | −26.4 | 7400 |
| Example 8 | −23.9 | 7100 |
| Comparative Example 1 | −15.1 | 5500 |

Referring to Table 1, the charge quantities of toner particles of Examples 1 to 8 prepared according to the present invention are −22.6 to −26.4 uC/g, which shows that the charge quantities are significantly higher than the charge quantity of toner particles prepared in Comparative Example 1, which is 15.1 μC/g.

Figure 2:
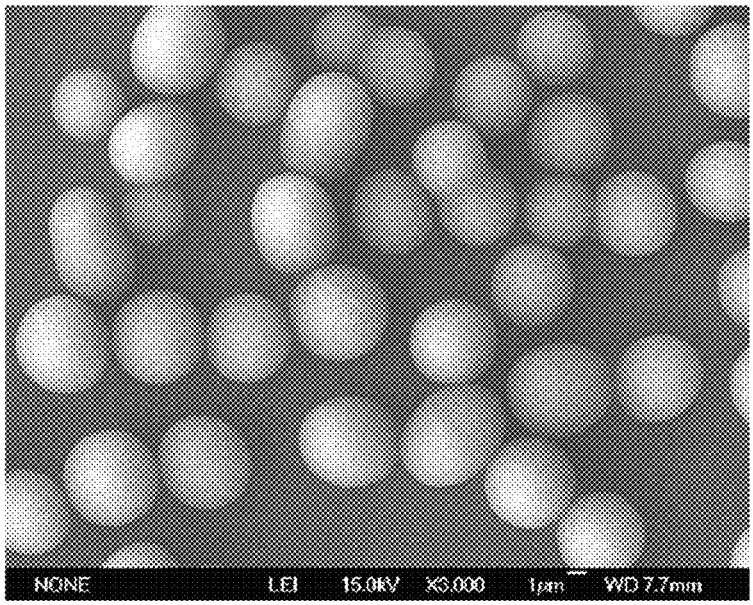
FIG. 2 is an SEM image of toner particles prepared using a method of preparing a toner according to another embodiment of the present invention.

Meanwhile, regarding the cleaning properties, the point where cleaning defects are occurred is over 7000 pages of printing for Examples 1 and 3 to 8, prepared according to the method of the present invention, which shows that the cleaning properties of the toner particles prepared according to the preparation method of the present invention are much better than that of Comparative Example 1, which is 5500 pages. In addition, it can be seen from FIG. 1, an SEM image of toner particles prepared according to Example 1, and from FIG. 2, an SEM image of toner particles prepared according to Example 2 with melt-adhering time different from that of Example 1, that the shapes of the toner particles can be conveniently controlled using the preparation method of the present invention, and cleaning properties of the toner particles can be enhanced by controlling the shapes of the toner particles. Referring to FIGS. 1 and 2, the cleaning properties of toner particles having an egg-shape or a distorted sphere shape with a longer diameter in a direction are much better than the cleaning properties of toner particles having a perfect sphere shape. Therefore, when such toner particles are used in electrophotographic image forming devices such as laser printers, the cleaning properties can be improved significantly.

While this invention has been particularly shown and described with reference to embodiments thereof, it will be understood by those skilled in the art that various changes in form and details may be made therein without departing from the spirit and scope of the invention as defined by the appended claims.

The invention claimed is:

1. A method of preparing a toner, comprising:

preparing a mixture by mixing a resin having acidic groups, a master batch of coloring pigment, and at least one additive with an organic solvent, and then neutralizing the acid groups of the resin with a base;

forming a micro-suspension by adding the prepared mixture to a dispersion medium, the dispersion medium comprising a polar solvent that is not mixed with the organic solvent, and a surfactant;

forming a toner composition by removing the organic solvent from the prepared micro-suspension; and aggregating the toner composition.

2. The method of claim 1, wherein the resin having acidic groups comprises a polyester resin having a number average molecular weight of 2,000 to 10,000, PDI of 2 to 15, THF insoluble part of 1 wt % or less, and an acid value of 5 to 100 mg KOH/g.

3. The method of claim 2, wherein the acid value of the polyester resin is 7 to 30 mg KOH/g.

4. The method of claim 1, wherein the coloring pigment master batch consists of 60 to 80 wt % of the resin having acidic groups and 20 to 40 wt % of the coloring pigment.

5. The method of claim 1, further comprising, after aggregating the toner composition, melt-adhering the aggregated toner composition; and forming toner particles by washing and drying the melt-adhered toner composition.

6. The method of claim 1, wherein the resin having acidic groups comprises at least one selected from the group consisting of carboxylic group, phosphoric acid group, and sulfonic acid group.

7. The method of claim 1, wherein the additive comprises at least one selected from the group consisting of a charge control agent and a releasing agent.

8. The method of claim 1, wherein the dispersion medium further comprises a thickener.

* * * * *